United States Patent [19]

Ruark

[11] Patent Number: 4,777,933

[45] Date of Patent: Oct. 18, 1988

[54] ACCESS DOOR CONSTRUCTION FOR A WATER HEATER

[75] Inventor: Darryl L. Ruark, Lugoff, S.C.

[73] Assignee: A. O. Smith Corporation, Milwaukee, Wis.

[21] Appl. No.: 117,335

[22] Filed: Nov. 6, 1987

[51] Int. Cl.[4] ..... F24H 1/00

[52] U.S. Cl. ..... 126/361; 126/350 R; 49/463; 220/305

[58] Field of Search ..... 126/361, 350 R, 367, 126/368, 344; 220/305; 49/463, 465, 466, 40

[56] References Cited

U.S. PATENT DOCUMENTS

| | | | |
|---|---|---|---|
| 456,494 | 7/1891 | Mahoney | 220/305 |
| 1,242,940 | 10/1917 | Hopper | 49/463 |
| 2,570,714 | 10/1951 | Robinson | 49/463 |
| 4,669,448 | 6/1987 | West | 126/361 |

*Primary Examiner*—James C. Yeung

*Attorney, Agent, or Firm*—Andrus, Sceales, Starke & Sawall

[57] ABSTRACT

An access door construction for a gas-fired water heater. The lower end of the outer jacket of the water heater is formed with an access opening and a door or panel bears against the outer surface of the jacket and encloses the opening. Tabs are formed on opposite side edges of the panel and engage the inner surface of the jacket adjacent the opening. In it unassembled condition, the panel is flat and when assembled with the cylindrical jacket, the resiliency of the panel will urge the tabs into tight engagement with the inner surface of the jacket. The panel is formed with a vertical channel having a generally semi-cylindrical cross section. By manually squeezing the sides of the channel together, the distance between the tabs will be decreased to thereby enable the panel to be removed and installed with the jacket.

14 Claims, 1 Drawing Sheet

ACCESS DOOR CONSTRUCTION FOR A WATER HEATER

BACKGROUND OF THE INVENTION

Gas-fired water heaters include a tank to contain water to be heated and an outer jacket or casing is spaced outwardly of the tank. Located within the space between the tank and the jacket is a layer of insulating material which can take the form of fiber glass or foamed resin.

In the conventional gas-fired water heater, the water is heated by a burner located in a compartment beneath the lower head of the tank. The lower end of the jacket is provided with an access opening in order to inspect and maintain the burner and pilot light or ignition device.

The access opening is customarily enclosed by a sheet metal panel or door, secured to the jacket by tabs that engage slots in the jacket. A corner of the panel is cut out to permit entry of the lines leading to the burner, pilot light and thermocouple.

It has been found that the access doors as used in the past are easily dislodged during shipping and handling of the water heater, with the result that the practice has been to wrap tape around the door to maintain it in place during shipment.

As a further disadvantage, the tabs on the conventional access door are easily bent during handling with the result that the tabs must be manually straightened before the door can be installed with the water heater jacket.

As the conventional access door is generally curved in shape, it is necessary to have a separate inventory of doors for water heaters of various diameters.

SUMMARY OF THE INVENTION

The invention is directed to an improved access door construction for a water heater. In accordance with the invention, the lower end portion of the outer jacket of the water heater is formed with an access opening and a door or panel bears against the outer surface of the jacket and encloses the opening. Tabs are formed on the opposite sides of the panel and are disposed in engagement with the inner surface of the jacket adjacent the opening.

The panel is generally flat before installation with the water heater jacket, and after installation, the natural resiliency of the panel will urge the tabs outwardly against the inner surface of the jacket to maintain the panel in position relative to the jacket.

The panel is formed with a generally semicylindrical channel, which extends the full height of the panel, and when used with a gas-fired water heater, the gas control lines extend through the upper end of the channel and are connected to the burner unit.

By manually squeezing the sides of the channel together, the distance between the tabs is decreased to thereby permit the panel to be removed and installed with the water heater jacket.

The access door or panel of the invention is firmly secured to the jacket, so that normal impact encountered in shipping and handling of the water heater will not dislodge the door.

The door can be readily installed and removed by applying inward pressure on the channel and no auxiliary fasteners or connectors are required to attach the panel to the jacket.

As the channel extends the full height of the panel, air can be drawn to the burner through both the upper and lower ends of the channel, which provides more effective air flow for combustion and a cleaner burn.

As a further advantage, the panel, in its unassembled form, is generally flat and, therefore, the panel can be utilized with water heater jackets of various diameters.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
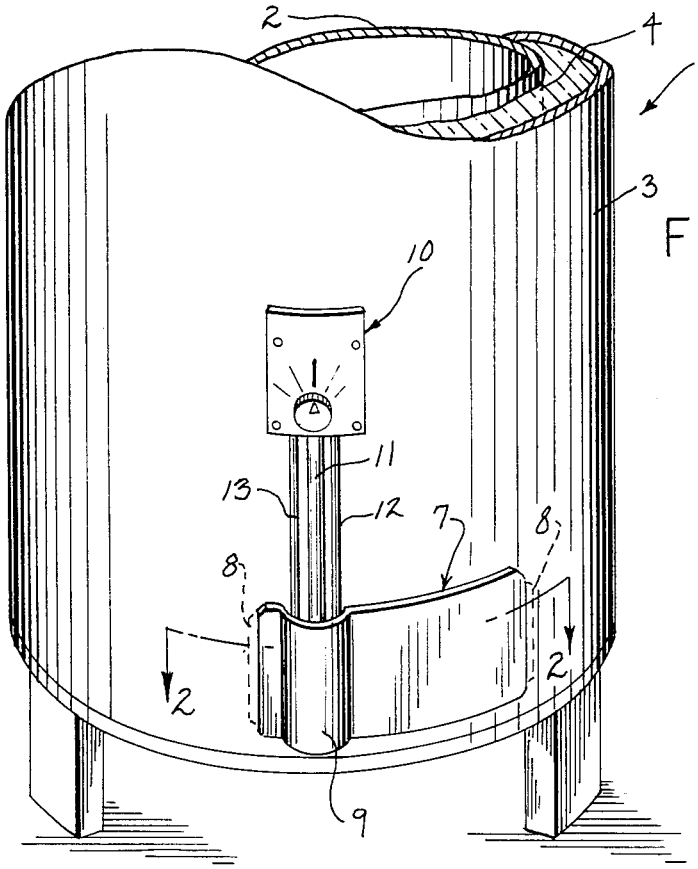
FIG. 1 is a front elevation of a gas-fired water heater incorporating the access door construction of the invention.

FIG. 1 shows the lower portion of a conventional gas-fired water heater 1 including a generally cylindrical tank 2 to contain water to be heated. Surrounding tank 2 is a sheet metal jacket 3 and a layer of insulation 4, which can take the form of fiber glass or foam resin, is interposed between tank 2 and jacket 3.

Water heater 1 is of conventional construction and as illustrated, a gas burner is located beneath the lower head of tank 2 and acts to heat the water within the tank. The waste gases of combustion are discharged through one or more flues which extend upwardly through the tank.

To provide access to the burner and its components, the lower portion of jacket 3 is formed with an access opening 6, which is enclosed by the door or panel 7 of the invention.

Panel 7 is generally rectangular in shape and is formed of a rigid, yet flexible, material such as sheet metal. The panel 7 is slightly larger in area than opening 6, so that the top and bottom edges of the panel will bear against the outer surface of jacket 3.

Located on opposite side edges of panel 7 are vertically extending tabs 8 which are offset inwardly from the body of the panel 7.

Figure 2:
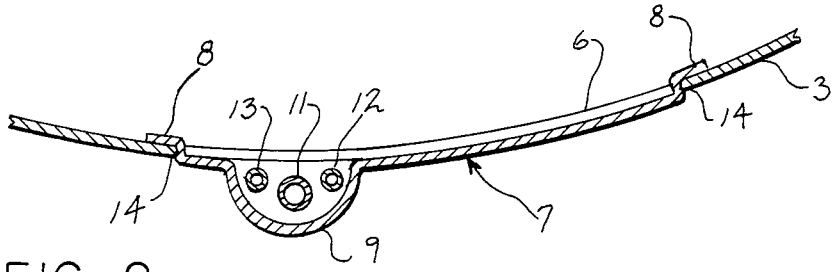
FIG. 2 is a section taken along line 2—2 of FIG. 1.
Figure 3:
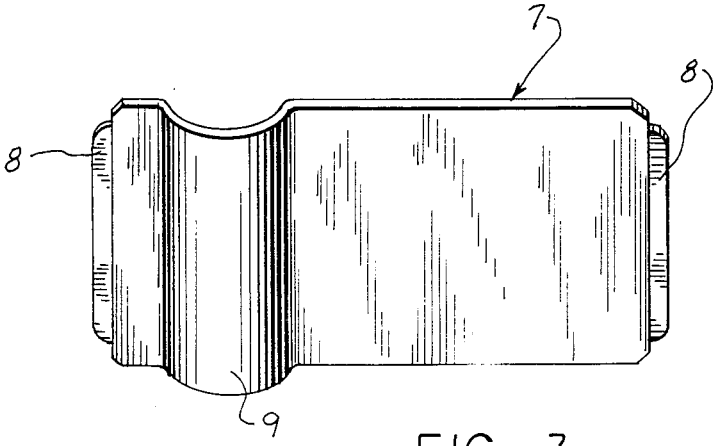
FIG. 3 is a perspective view of the door panel in its unassembled form.

In the installed condition, as shown in FIGS. 1 and 2, tabs bear against the inner surface of the jacket 3. In its unassembled condition, as shown in FIG. 3, panel 7 is generally flat or planar and when assembled with the cylindrical jacket 3, the natural resiliency of the panel 7 will act to urge tabs 8 outwardly against the inner surface of jacket 3 to firmly hold the panel to the jacket.

Extending the full height of panel 7 is a channel 9 having a generally semi-cylindrical cross section. A conventional gas valve assembly 10 is mounted on the outer surface of the jacket and the gas line 11, pilot line 12 and thermocouple line 13 extend from the assembly 10 through the channel 9 and are connected to the burner assembly 5, which is located beneath the tank 2.

Channel 9 provides a multiple function in that it not only serves as a conduit which receives the lines 10–12, but air for burner combustion is introduced into the burner chamber through both the open upper and lower ends of channel 9, which provides a more effective air flow for combustion. In addition, channel 9 provides a means for installing and removing the panel 7 from opening 6. When installed, the door can be removed by manually squeezing the sides of the channel 9 together, which will decrease the distance between tabs 8 and enable the panel to be removed from the opening 6. Similarly, to install the door, the tab 8 adjacent the long side of panel 7 is inserted through the opening 6 behind the jacket 3 and the sides of the channel 9 are then squeezed together and the other tab is then inserted in position behind the jacket. On release of the manual pressure on channel 9, the tabs 8 will spring apart to bring the shoulders 14 bordering tabs 8 into engagement with the respective edges of opening 6 and firmly hold the panel to the jacket.

The access door construction of the invention has distinct advantages over access doors as used in the past. The panel or door 7 is firmly engaged with the opening 6 and will not be dislodged by normal impact encountered during shipping and handling of the water heater.

As the door 7, before assembly with the water heater jacket, is generally flat, the natural resiliency of the door, when assembled, will urge the tabs 8 into firm engagement with the inner surface of the jacket bordering the opening. Further, the flat configuration enables the door to be used with various diameter water heater jackets, thereby substantially reducing the necessary inventory of access doors.

The channel 9 serves a multiple function, providing a passage for combustion air, a conduit to receive the gas lines, as well as providing a mechanism for engaging and disengaging the door from the opening.

While the drawings have illustrated the invention as associated with a gas-fired water heater, it is contemplated that the access door construction can also be employed to enclose various types of openings in other vessels.

Various modes of carrying out the invention are contemplated as being within the scope of the following claims particulary pointing out and distinctly claiming the subject matter which is regarded as the invention.

I claim:

1. An access door construction comprising a generally cylindrical structure having an opening therein, a flexible resilient door panel having a generally flat configuration when in an unassembled condition with said structure, tab means disposed at opposite ends of said door panel and disposed to engage the inner surface of said structure bordering said opening, said panel disposed in an outwardly bowed condition when assembled with said structure and the resiliency of said bowed panel acting to urge said tabs against the inner surface of said structure, and means connected to the panel for permitting the tabs to be manually moved inwardly toward each other to decrease the distance between said tab means to enable said door panel to be withdrawn from said opening.

2. The construction of claim 1, wherein said structure is an outer jacket for a water heater.

3. The construction of claim 1, wherein said panel is composed of sheet metal.

4. The construction of claim 1, wherein said means for permitting the tabs to be manually moved toward each other comprises an outwardly extending channel disposed in said door panel and extending generally normal to the direction between said tab means.

5. The construction of claim 4, wherein said channel extends continuously between opposed sides of said door panel.

6. The construction of claim 1, wherein said tab means are offset inwardly from said door panel.

7. A water heater construction, comprising a tank to contain water to be heated, a cylindrical jacket spaced outwardly of said tank and having an access opening in the lower portion thereof, a flexible panel disposed against the outer surface of said jacket and substantially enclosing said opening, tab means disposed at opposite ends of said panel and disposed to engage the inner surface of said jacket bordering said access opening, and outwardly extending channel means disposed on said panel and extending generally normal to the direction between said tab means, application of manual pressure to opposite sides of said channel means acting to decrease the distance between said tab means to enable said panel to be installed and removed from said opening.

8. The water heater of claim 7, and including fuel supply means connected to a fuel burner and extending through said channel means to the exterior of said jacket.

9. The water heater of claim 8, wherein said channel means is generally semi-cylindrical in cross section.

10. In a water heater, a tank to contain water to be heated, a generally cylindrical outer jacket spaced outwardly of said tank, an access opening disposed in the lower portion of said jacket, a flexible door panel disposed against the outer surface of said jacket and enclosing said opening, said door panel having a pair of opposed first edges and a pair of opposed second edges, a tab disposed on each of said first edges, said tabs disposed in engagement with the inner surface of said jacket bordering said opening, said panel in an unassembled condition with said jacket being generally flat and when assembled with said cylindrical jacket said panel being bent to a generally curved condition, the resiliency of said panel when in said curved condition acting to urge said tabs against the inner surface of said jacket, and a channel projecting outwardly from the panel and extending between said second edges, application of manual pressure to the sides of said channel acting to decrease the distance between said tabs to enable the panel to be installed and removed from said opening.

11. The water heater of claim 10, wherein said channel has a pair of open ends, each disposed adjacent one of said second edges.

12. The water heater of claim 10, wherein each tab is offset inwardly from said panel and connected to the respective first edge by a shoulder, said shoulders being engaged with opposed edges of said opening.

13. The water heater of claim 10, and including burner means to heat the water in the tank and located beneath the tank and within the jacket, and fuel supply means disposed in said channel and connected to said burner means.

14. An access door construction, comprising a generally cylindrical structure having an opening therein bordered by a pair of opposed edges, a flexible resilient door panel including a central body portion and end tabs disposed at opposite ends of said body portion, said body portion having a generally flat configuration when in an unassembled condition with said cylindrical structure and said end tabs being offset inwardly from said body portion and connected to said body portion by shoulders, said tabs disposed in engagement with the inner surface of said cylindrical structure bordering said opening and said shoulders disposed in engagement with said edges, said body portion being constructed and arranged so that said body portion is bowed outwardly when said shoulders are engaged with said edges so that said body portion conforms generally to the curvature of said cylindrical structure.

* * * * *